US005558510A

United States Patent [19]

Makino et al.

[11] Patent Number: 5,558,510

[45] Date of Patent: Sep. 24, 1996

[54] SCROLL COMPRESSOR HAVING WRAP ELEMENTS WITH RIGIDIFIED INNER ENDS

[75] Inventors: Masahiko Makino, Yawata; Michio Yamamura; Masafumi Fukushima, both of Kusatsu; Kunio Iwanami, Moriyama, all of Japan

[73] Assignee: Matsushita Electric Industrial Co., Ltd., Osaka-fu, Japan

[21] Appl. No.: 449,372

[22] Filed: May 24, 1995

[30] Foreign Application Priority Data

Apr. 17, 1995 [JP] Japan ..... 7-090700

[51] Int. Cl.[6] ..... F01C 1/04

[52] U.S. Cl. ..... 418/55.2; 418/150

[58] Field of Search ..... 418/55.2, 150

[56] References Cited

U.S. PATENT DOCUMENTS 4,547,137 10/1985 Terauchi et al. ..... 418/55.2

4,558,997 12/1985 Sakata et al. ..... 418/55.2

4,678,416 7/1987 Hirano et al. ..... 418/55.2

*Primary Examiner*—Charles Freay

*Attorney, Agent, or Firm*—Wenderoth, Lind & Ponack

[57] ABSTRACT

A scroll compressor includes a stationary scroll and an orbiting scroll having respective wrap elements in engagement with each other. An inner end portion of an internal wall of one of the wrap elements is partially shaped to represent a curve identical to or approximate to an envelope curve which is obtained through circular translation of a circular arc connected with an external wall of the other wrap element. The radius of the circular arc is so chosen as to increase the shortest distance $a_x$ from each of points on the curve to the external wall of the one wrap element towards the inner end of the one wrap element.

4 Claims, 8 Drawing Sheets

SCROLL COMPRESSOR HAVING WRAP ELEMENTS WITH RIGIDIFIED INNER ENDS

BACKGROUND OF THE INVENTION

The present invention relates generally to a scroll compressor and, more particularly, to the shape of spiral wrap elements of stationary and orbiting scrolls of the scroll compressor.

Generally available scroll compressors comprise a stationary scroll and an orbiting scroll, both of which have respective wrap elements each having an internal wall and an external wall opposite to each other.

In almost all of the scroll compressors, the internal and external walls are shaped so as to represent two involute curves, both of which are based on an identical involute base circle, but have different phases and, hence, the wall thickness thereof is made constant from an inner end to an outer end of each of the wrap elements. The compressing action is achieved by circling one of the wrap elements relative to the other under the condition in which the two wrap elements are circumferentially shifted 180° one from the other with the side walls thereof held in partial contact with each other.

Alternatively, the internal wall of one of the two wrap elements can be shaped to represent a curve developing from the center of a base circle so as to extend spirally outwardly therefrom, while the external wall of said one of the two wrap elements is shaped based on the shape of the internal wall. In this case, the other wrap element is shaped with envelope curves obtained as a result of circular translation of said one wrap element relative thereto. The scroll compressors of this type have the advantage of being capable of enlarging the volume of entrapment, if the cylinder bore is identical, by making the factor of development (a) large, compared with those of the aforementioned type having the wrap elements so shaped as to represent the involute curves. If the intake volume is identical, the outer diameter of a shell can be reduced, contributing to the compactness or light-weight of the whole compressor.

However, if the wrap elements are shaped in this way, said one wrap element becomes thin at an inner end portion thereof, while the other wrap element inevitably has a sharp edge at an inner end portion thereof. Such wrap elements are shown in, for example, FIG. 1, requiring a specific change in shape to increase the strength thereof.

Several patent documents including U.S. Pat. No. 4,547,137 disclose an improved shape of the inner end portions of the wrap elements. According to these documents, the two wrap elements are shaped symmetrically by merely connecting involute curves with arcuate or straight lines. If the two wrap elements are of asymmetrical shapes, they cannot be shaped in a simple manner but must be shaped in consideration of the circular translation of one of them relative to the other. Furthermore, if the inner end walls of the wrap elements are unnecessarily made thick for the purpose of merely increasing the strength thereof, light-weight compressors cannot be expected. Also, enlargement in volume of entrapment of a final chamber delimited by the inner end walls of the two wrap elements results in a reduction in compression ratio or a re-expansion loss, adversely affecting the performance of the compressors.

SUMMARY OF THE INVENTION

The present invention has been developed to overcome the above-described disadvantages.

It is accordingly an objective of the present invention to provide an improved scroll compressor of which inner end portions of two wrap elements are increased in strength without increasing the weight thereof or lowering the performance of the scroll compressor.

In accomplishing the above and other objectives, the scroll compressor of the present invention includes first and second wrap elements in engagement with each other, wherein an internal wall of the first wrap element has a principal portion that extends spirally outwardly from an inner end portion thereof and is shaped so as to represent a curve given by $r=a\phi$ on a polar coordinate $(r, \phi)$, while an external wall of the first wrap element has a principal portion that extends spirally outwardly from an inner end portion thereof and is shaped so as to represent a curve given by $r=a\phi+b$, each of said (a) and (b) being a constant. The internal wall of the second wrap element has a principal portion that extends spirally outwardly from the inner end portion thereof and is shaped with an envelope curve obtained as a result of circular translation of the external wall of the first wrap element relative to the second wrap element. Likewise, the external wall of the second wrap element has a principal portion that extends spirally outwardly from the inner end portion thereof and is shaped with an envelope curve obtained as a result of circular translation of the internal wall of the first wrap element relative to the second wrap element.

Furthermore, the inner end portion of the internal wall of the second wrap element is partially shaped to represent a first curve approximate to an envelope curve that is obtained by circulating a first circular arc of a given radius connected with the inner end portion of the external wall of the first wrap element at a first given point, said first circular arc having a common tangent with the external wall of the first wrap element at the first given point. The radius of the first circular arc is chosen so that the shortest distance from each point on the first curve to the external wall of the second wrap element may increase towards an inner end of the second wrap element. Likewise, the inner end portion of the internal wall of the first wrap element is partially shaped to represent a second curve approximate to an envelope curve that is obtained by circulating a second circular arc of a given radius connected with the inner end portion of the external wall of the second wrap element at a second given point, said second circular arc having a common tangent with the external wall of the second wrap element at the second given point. The radius of the second circular arc is chosen so as to increase the shortest distance from each point on the second curve to the external wall of the first wrap element towards an inner end of the first wrap element.

In another form of the present invention, the inner end portion of the internal wall of the first wrap element is partially shaped to represent a first curve so that the shortest distance from each point on the first curve to the external wall of the first wrap element may increase towards an inner end of the first wrap element, while the inner end portion of the internal wall of the second wrap element is partially shaped to represent a second curve so that the shortest distance from each point on the second curve to the external wall of the second wrap element may increase towards an inner end of the second wrap element. In this case, the inner end of the first wrap element is shaped with an envelope curve of the second curve when the second wrap element is moved to undergo circular translation relative to the first wrap element, while the inner end of the second wrap element is shaped with an envelope curve of the first curve when the first wrap element is moved to undergo circular translation relative to the second wrap element.

Advantageously, the inner end of the first wrap element is spaced away from the internal wall of the second wrap element, while the inner end of the second wrap element is similarly spaced away from the internal wall of the first wrap element.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
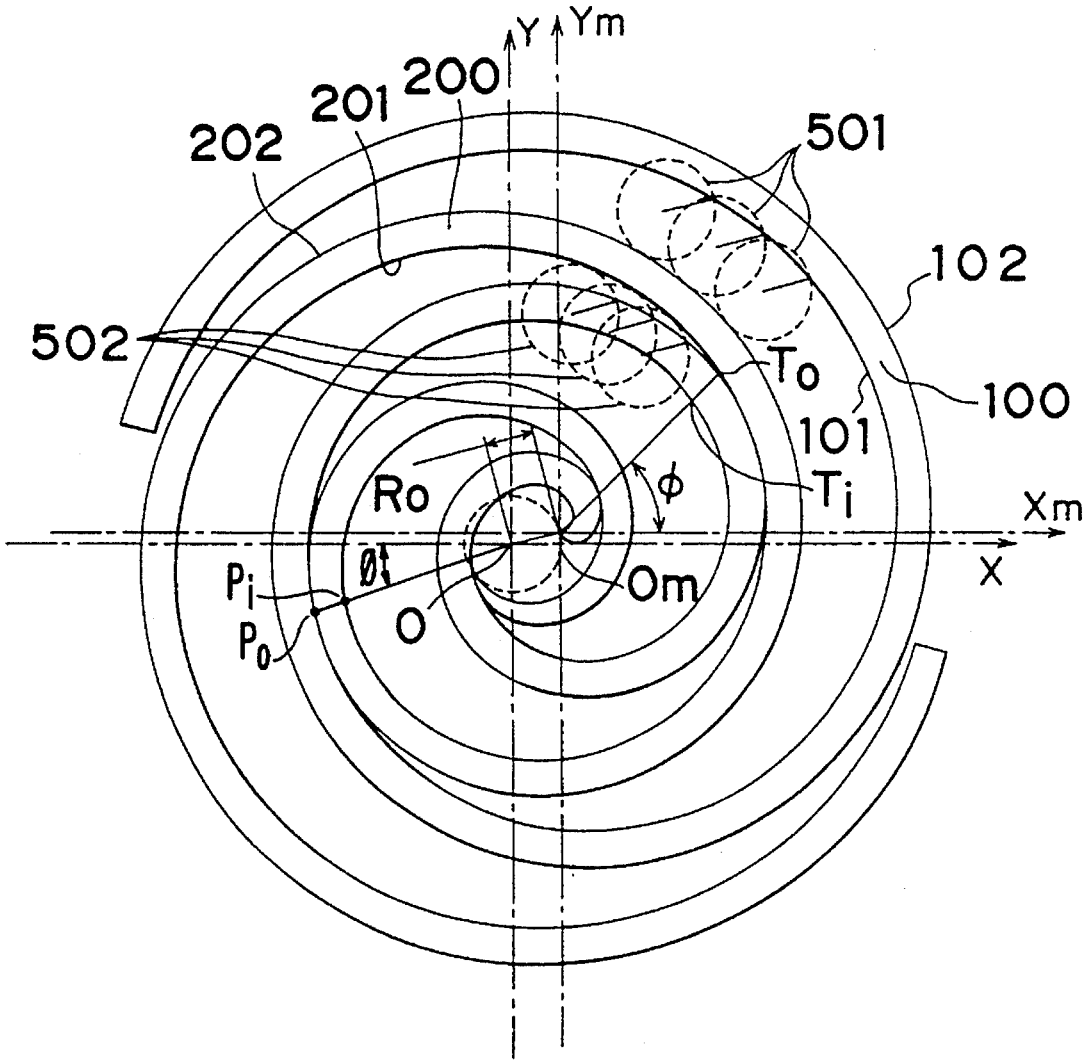
FIG. 1 is a schematic view of stationary and orbiting wrap elements in engagement with each other of which the shapes of inner end portions are to be modified for the practice of the present invention.

Referring now to the drawings, there are shown in FIG. 1 a stationary wrap element 200 and an orbiting wrap element 100 in engagement with each other. The stationary wrap element 200 has an inner end portion and a principal portion extending spirally outwardly therefrom, while the orbiting wrap element 100 similarly has an inner end portion and a principal portion extending spirally outwardly therefrom.

In FIG. 1, relative coordinates (Xm, Ym) of the orbiting wrap element 100 undergo circular translation with a radius $R_0$ about the origin O of coordinates (X, Y) of the stationary wrap element 200. The distances from the origin Om to arbitrary points Ti and To of the internal and external walls 101 and 102 of the orbiting wrap element 100 are given respectively by:

$$OmTi=fi(\phi)=a\phi(a>0)$$

$$OmTo=fo(\phi)=a\phi+b\ (b>0)$$

where $\phi$ denotes the winding angle from the Xm-axis and is positive in the counterclock-wise direction.

On the other hand, the internal wall 201 of the stationary wrap element 200 is shaped with an envelope curve of locus circles of a radius $R_0$ which points on the external wall 102 of the orbiting wrap element 100 draw, while the external wall 202 of the stationary wrap element 200 is shaped with an envelope curve of locus circles of a radius $R_0$ which points on the internal wall 101 of the orbiting wrap element 100 draw. The coordinates (X, Y) of arbitrary points Pi and Po on the internal and external walls 201 and 202 of the stationary wrap element 200 are given respectively by:

$$Xi=fo(\phi)\cdot\cos\phi+Ro\cdot\cos(\phi-\alpha_o)$$

$$Yi=fo(\phi)\cdot\sin\phi+Ro\cdot\sin(\phi-\alpha_o)$$

$$Xo=fi(\phi)\cdot\cos\phi-Ro\cdot\cos(\phi-\alpha_i)$$

$$Yo=fi(\phi)\cdot\sin\phi+Ro\cdot\sin(\phi-\alpha_i)$$

where $$\alpha_i=\tan^{-1}\{fi'(\phi)/fi(\phi)\}$$

$$\alpha_o=\tan^{-1}\{fo'(\phi)/fo(\phi)\}$$

Figure 2:
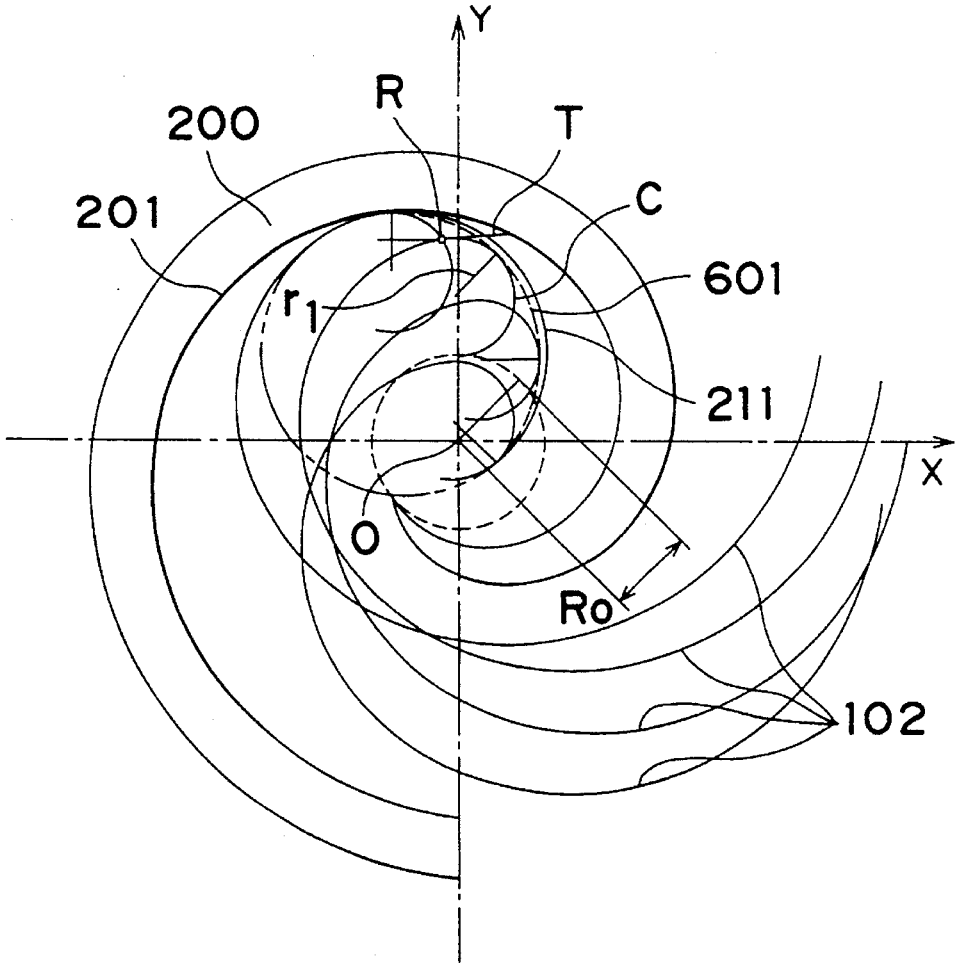
FIG. 2 is a diagram indicating the manner in which an internal wall of the inner end portion of the stationary wrap element is shaped through circular translation of points on an external wall of the other wrap element relative thereto.

FIG. 2 depicts the manner in which an inner end portion of the internal wall 201 of the stationary wrap element 200 is shaped.

As shown in FIG. 2, a specific point, identified by R, on the external wall 102 of the orbiting wrap element 100 close to the inner end thereof is first connected with a circular arc C of a radius $r_1$ that has a common tangent T with the external wall 102 of the orbiting wrap element 100 at the point R. A subsequent circular translation of the circular arc C about the origin O forms an envelope curve 601 indicated by a dotted line in FIG. 2. For the purpose of the present invention, the inner end portion of the internal wall 201 of the stationary wrap element 200 is partially shaped with this envelope curve 601 or to represent a curve 211 approximate thereto. The curve 211 is hereinafter referred to as an inner end connecting curve.

Figure 3:
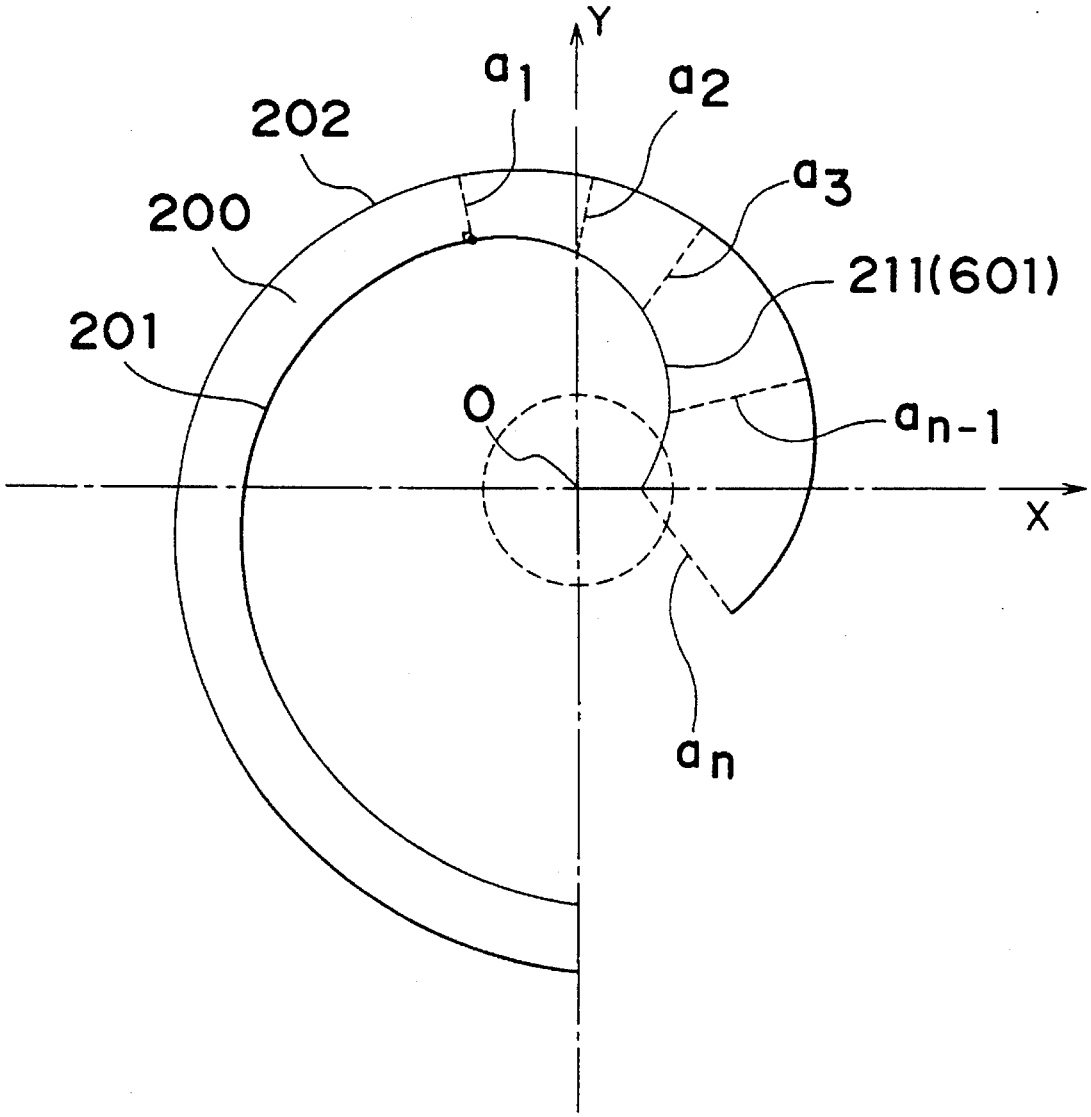
FIG. 3 is a partial schematic view of the inner end portion of the stationary wrap element shaped in the manner shown in FIG. 2.

As shown in FIG. 3, the radius $r_1$ of the circular arc C is chosen so that the shortest distance $a_x$ from each of points on the curve 211 to the external wall curve 202 may increase towards the inner end of the stationary wrap element 200 ($a_1<a_2<\ldots<a_n$).

Figure 4:
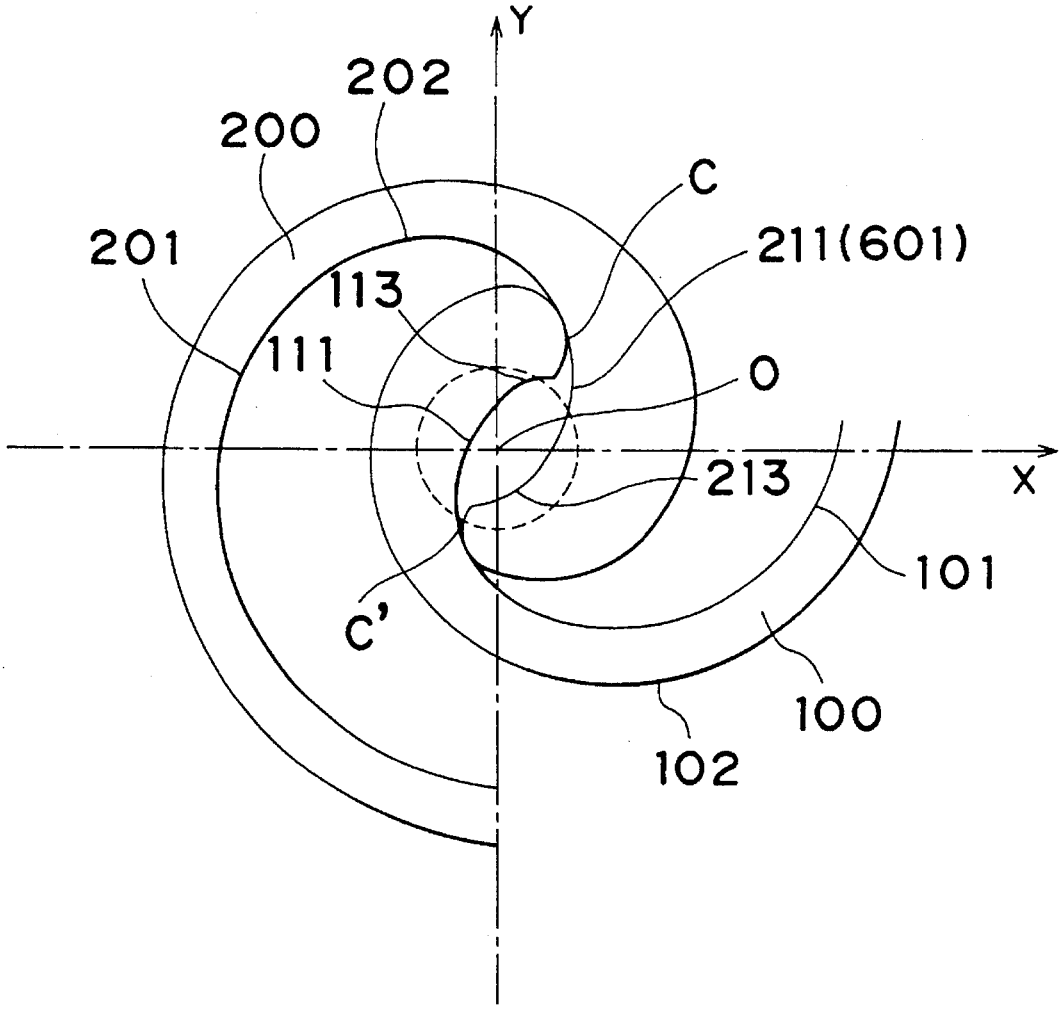
FIG. 4 is a schematic view of the inner end portions of the stationary and orbiting wrap elements according to a first embodiment of the present invention.

As shown in FIG. 4, the inner end of the stationary wrap element 200 is rounded to represent a circular arc C' and is connected with the inner end connecting curve 211 via a curve 213 which may be a circular arc of a given radius. The circular arc C' has a radius equal to or approximately equal to that of the circular arc C.

An inner end portion of the orbiting wrap element 100 is shaped in the same manner as that of the stationary wrap element 200. More specifically, the inner end portion of the internal wall 101 of the orbiting wrap element 100 is partially shaped to represent an inner end connecting curve 111, which is obtained in the same manner as the inner end connecting curve 211 referred to above and is connected with the rounded inner end via a curve 113 which may be a circular arc of a given radius.

Figure 5:
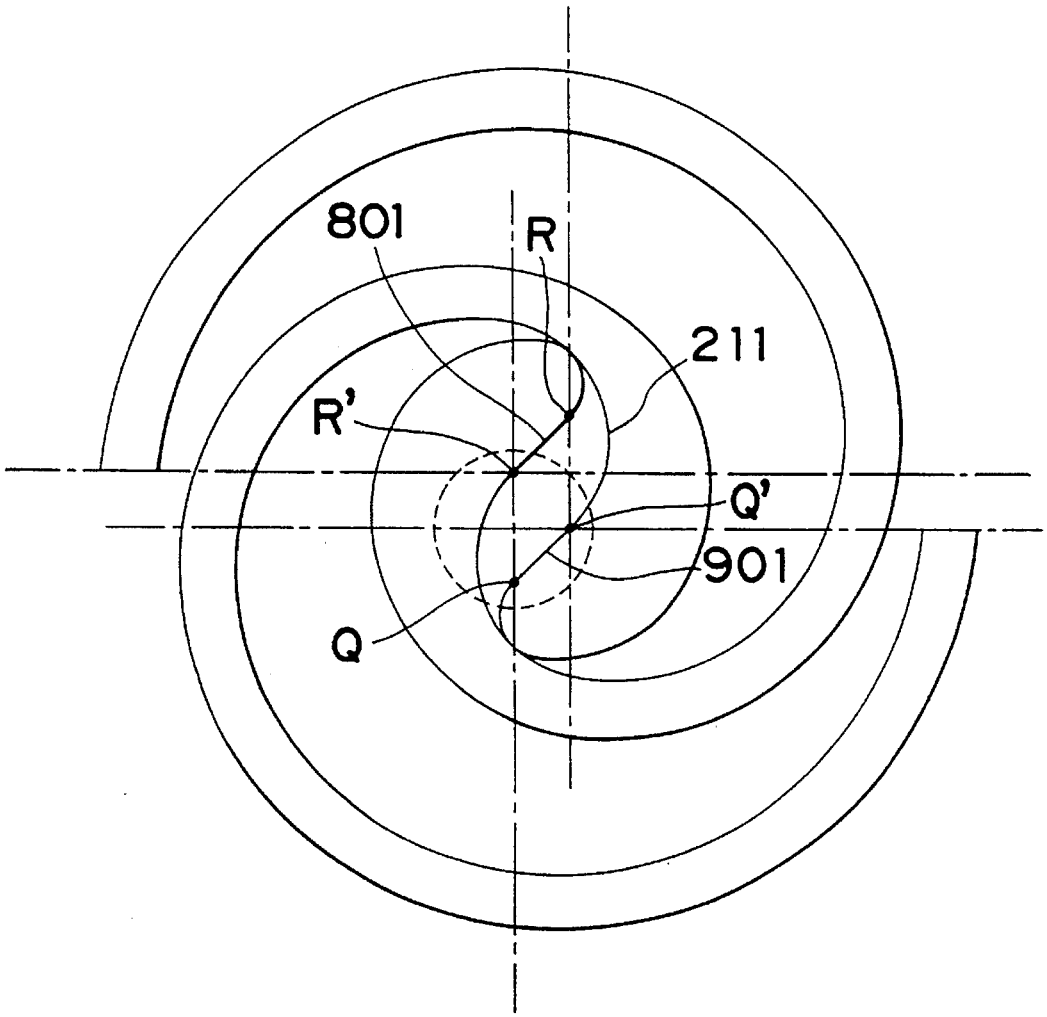
FIG. 5 is a view similar to FIG. 4, but according to a modification thereof.

FIG. 5 depicts modified shapes of the inner end portions of the orbiting and stationary wrap elements 100 and 200 shown in FIG. 4. In the modification shown in FIG. 5, the curves 113 and 213, both shown in FIG. 4, are replaced by straight lines 801 and 901, respectively. The straight line 801 has common tangents on opposite ends thereof R and R' with associated curves connected thereto, while the straight line 901 similarly has common tangents on opposite ends thereof Q and Q' with associated curves connected thereto.

It is to be noted here that although in the above-described embodiment shaping of the inner end portion of the internal wall 201 of the stationary wrap element 200 is carried out prior to that of the inner end portion of the internal wall 101 of the orbiting wrap element 100, the latter may be carried out prior to the former.

Figure 6:
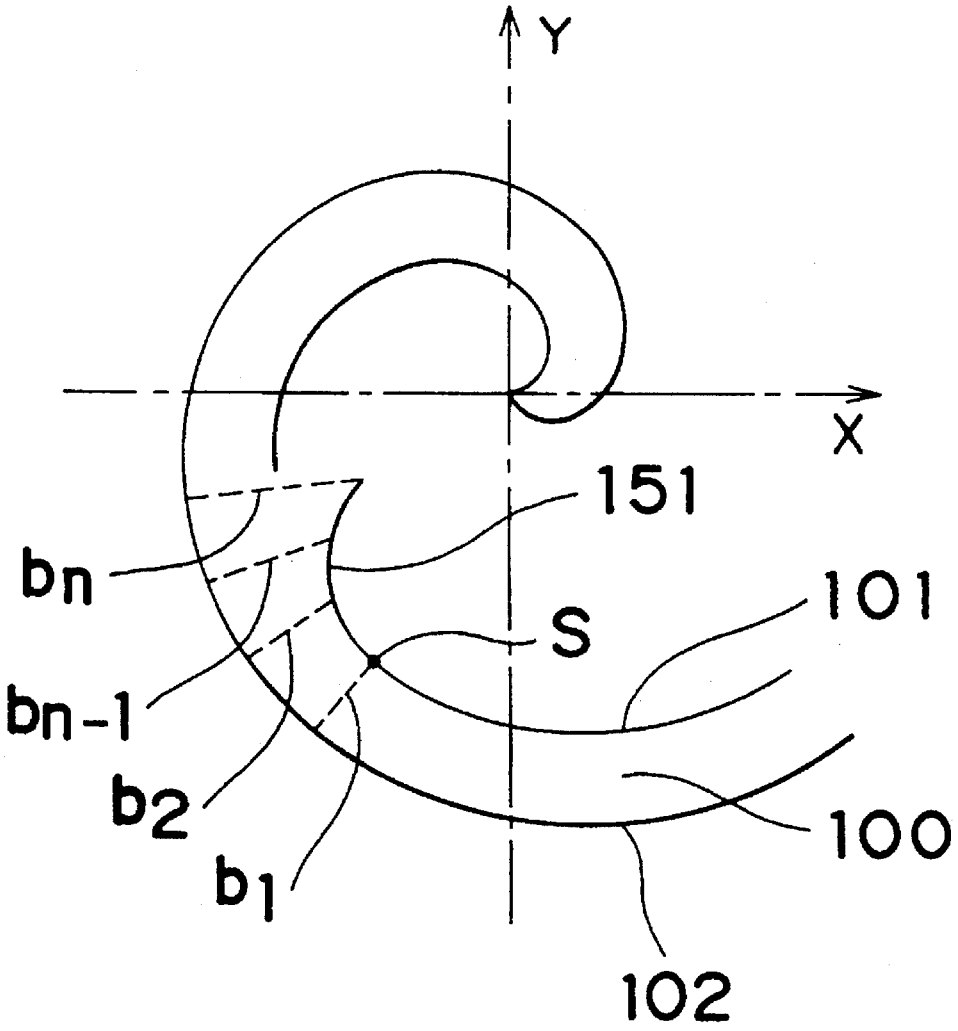
FIG. 6 is a diagram indicating the manner in which the orbiting wrap element according to a second embodiment of the present invention is shaped.

FIG. 6 depicts the inner end portion of the orbiting wrap element 100 according to a second embodiment of the present invention. As shown therein, a specific point, identified by S, on the internal wall 101 of the orbiting wrap element 100 close to the inner end thereof is connected with an inner end connecting curve 151, for example, a circular arc of a given radius, which is in turn connected with rounded inner end via a given curve (not shown). The inner end connecting curve 151 is so chosen as to increase the shortest distance $b_x$ from each point on the curve 15 1 to the external wall curve 102 towards the inner end of the orbiting wrap element 100 ($b_1<b_2<\ldots<b_n$).

Figure 7:
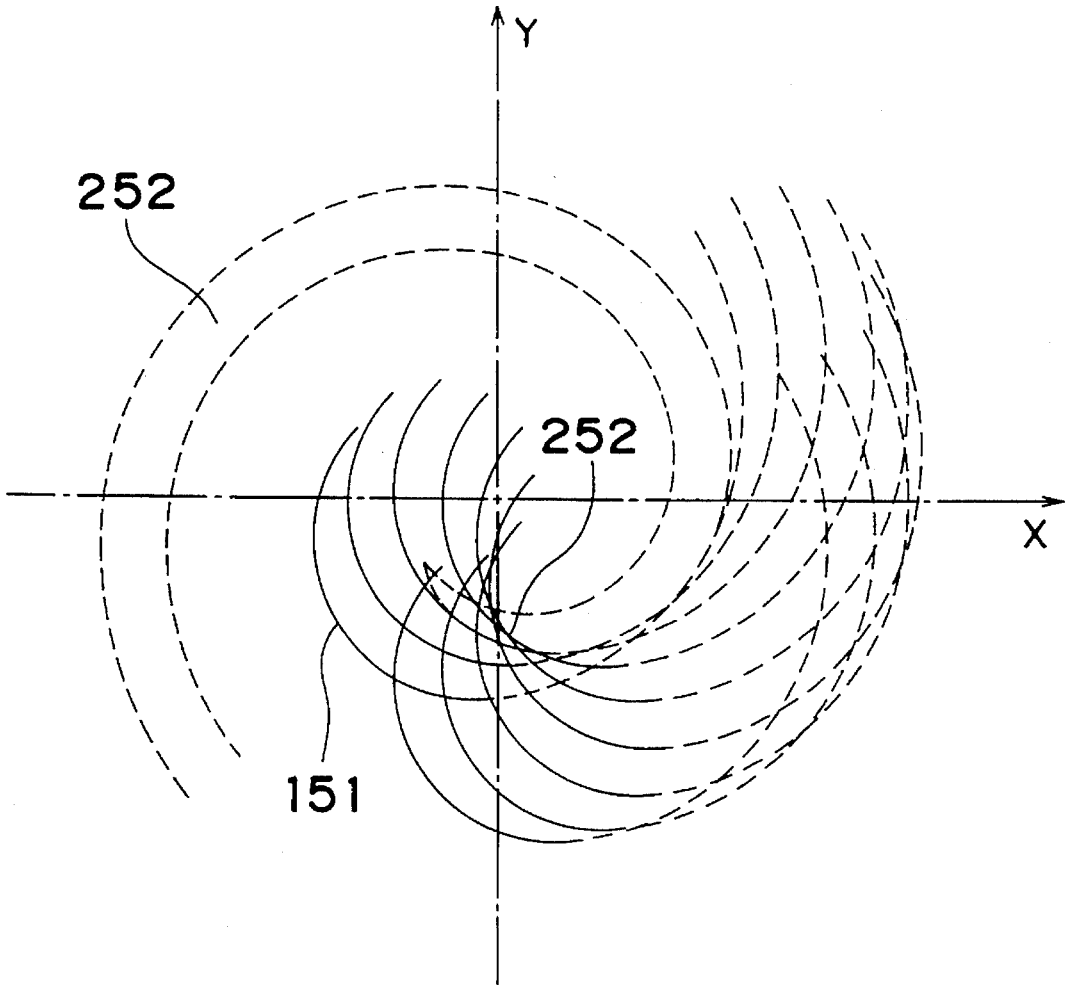
FIG. 7 is a diagram indicating the manner in which the inner end of the stationary wrap element according to the second embodiment of the present invention is shaped.

FIG. 7 depicts an inner end connecting curve 252 of the external wall 202 of the stationary wrap element 200 that is formed with an envelope curve of the inner end connecting curve 151 when the orbiting wrap element 100 is moved to undergo circular translation of a radius Ro about the origin O.

However, the two wrap elements thus formed provide a final chamber delimited by the inner end walls thereof with substantially no volume and, also, provide a relatively narrow communication passage leading to an intermediate chamber, thus generating a considerably high pressure during liquid compression.

Figure 8:
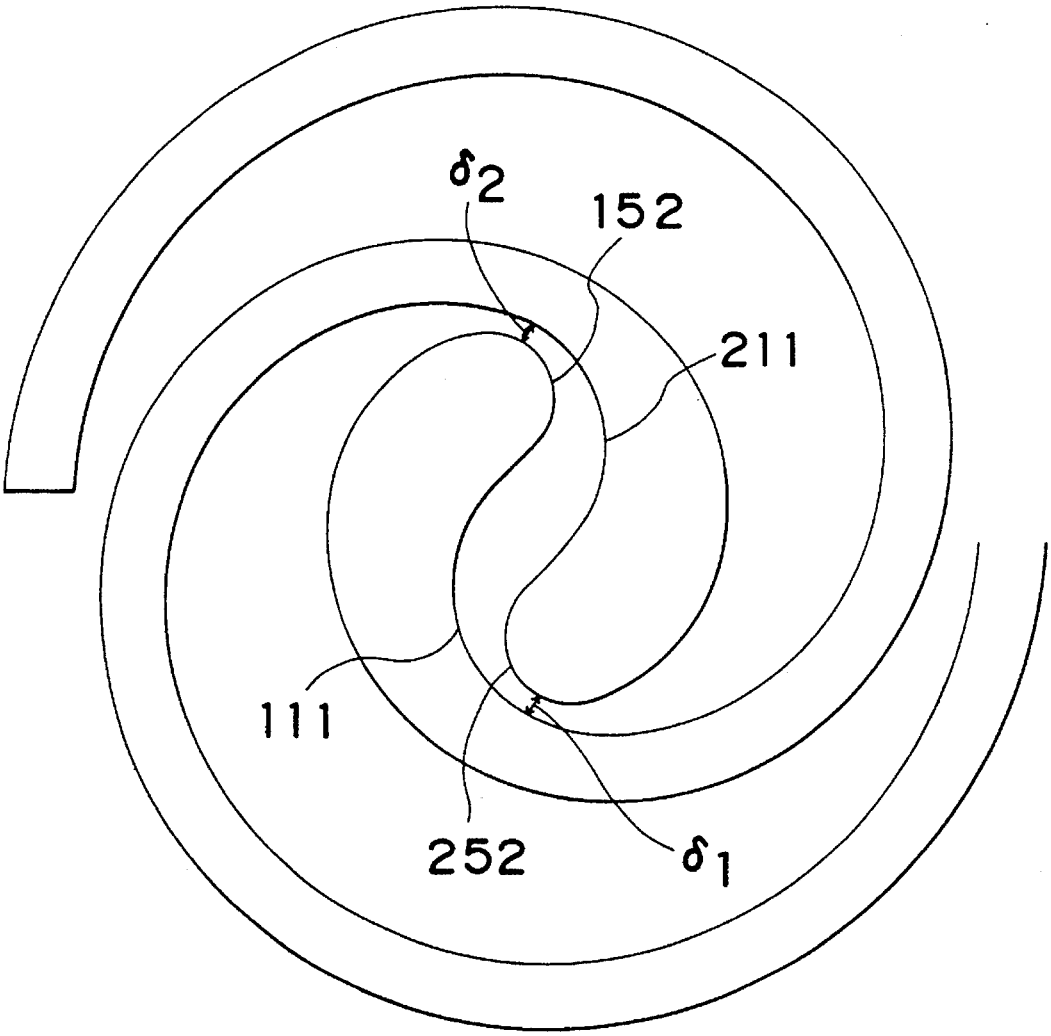
FIG. 8 is a view similar to FIGS. 4 or 5, but indicating a modified form thereof.

This problem can be overcome by appropriately moving the inner end connecting curves, as shown in FIG. 8, so that the inner end connecting curve 252 connected to the external wall of the stationary wrap element 200 is spaced δ1 away from the inner end connecting curve 111 connected to the internal wall of the orbiting wrap element 100, while the inner end connecting curve 152 connected to the external wall of the orbiting wrap element 100 is spaced δ2 away from the inner end connecting curve 211 connected to the internal wall of the stationary wrap element 200. An appropriate selection of the clearances δ1 and δ2 can protect the wrap elements 100 and 200 in the event of generation of an excessively high pressure without reducing the performance of the compressor.

As is clear from the above, according to the present invention, both of the wrap elements 100 and 200 can be increased in strength by modifying the shape of the inner ends thereof without increasing the weight thereof or lowering the performance of the compressor.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. In a scroll compressor having first and second wrap elements in engagement with each other, each of said first and second wrap elements having an internal wall and an external wall opposite to each other and also having an inner end portion and an outer end portion opposite to each other, wherein the improvement comprises:

the internal wall of said first wrap element having a principal portion that extends spirally outwardly from the inner end portion thereof and is shaped with a curve given by $r=a\phi$ on a polar coordinate $(r, \phi)$, said (a) being a constant;

the external wall of said first wrap element having a principal portion that extends spirally outwardly from the inner end portion thereof and is shaped with a curve given by $r=a\phi+b$, said (b) being a constant;

the internal wall of said second wrap element having a principal portion that extends spirally outwardly from the inner end portion thereof and is shaped with an envelope curve obtained as a result of circular translation of the external wall of said first wrap element relative to said second wrap element;

the external wall of said second wrap element having a principal portion that extends spirally outwardly from the inner end portion thereof and is shaped with an envelope curve obtained as a result of circular translation of the internal wall of said first wrap element relative to said second wrap element;

the inner end portion of the internal wall of said second wrap element being partially shaped to represent a first curve approximate to an envelope curve that is obtained by circulating a first circular arc of a given radius connected with the inner end portion of the external wall of said first wrap element at a first given point, said first circular arc having a common tangent with the external wall of said first wrap element at said first given point, a shortest distance from each point on said first curve to the external wall of said second wrap element increasing towards an inner end of said second wrap element; and the inner end portion of the internal wall of said first wrap element being partially shaped to represent a second curve approximate to an envelope curve that is obtained by circulating a second circular arc of a given radius connected with the inner end portion of the external wall of said second wrap element at a second given point, said second circular arc having a common tangent with the external wall of said second wrap element at said second given point, a shortest distance from each point on said second curve to the external wall of said first wrap element increasing towards an inner end of said first wrap element.

2. The scroll compressor according to claim 1, wherein the inner end of said first wrap element is spaced away from the internal wall of said second wrap element, while the inner end of said second wrap element is spaced away from the internal wall of said first wrap element.

3. In a scroll compressor having first and second wrap elements in engagement with each other, each of said first and second wrap elements having an internal wall and an external wall opposite to each other and also having an inner end portion and an outer end portion opposite to each other, wherein the improvement comprises:

the internal wall of said first wrap dement having a principal portion that extends spirally outwardly from the inner end portion thereof and is shaped with a curve given by $r=a\phi$ on a polar coordinate $(r, \phi)$, said (a) being a constant;

the external wall of said first wrap element having a principal portion that extends spirally outwardly from the inner end portion thereof and is shaped with a curve given by $r=a\phi+b$, said (b) being a constant;

the internal wall of said second wrap element having a principal portion that extends spirally outwardly from the inner end portion thereof and is shaped with an envelope curve obtained as a result of circular translation of the external wall of said first wrap element relative to said second wrap element;

the external wall of said second wrap element having a principal portion that extends spirally outwardly from the inner end portion thereof and is shaped with an envelope curve obtained as a result of circular translation of the internal wall of said first wrap element relative to said second wrap element;

the inner end portion of the internal wall of said first wrap element being partially shaped to represent a first curve so that a shortest distance from each point on said first curve to the external wall of said first wrap element increases towards an inner end of said first wrap element;

the inner end portion of the internal wall of said second wrap element being partially shaped to represent a second curve so that a shortest distance from each point on said second curve to the external wall of said second wrap element increases towards an inner end of said second wrap element;

the inner end of said first wrap element being shaped with an envelope curve of said second curve when said second wrap element is moved to undergo circular translation relative to said first wrap element; and the inner end of said second wrap element being shaped with an envelope curve of said first curve when said first wrap element is moved to undergo circular translation relative to said second wrap element.

4. The scroll compressor according to claim 3, wherein the inner end of said first wrap element is spaced away from the internal wall of said second wrap element, while the inner end of said second wrap element is spaced away from the internal wall of said first wrap element.

* * * * *